US006141028A

United States Patent [19]

Aruga

[11] Patent Number: 6,141,028

[45] Date of Patent: Oct. 31, 2000

[54] PRINTER AND CONTROL METHOD THEREFOR

[75] Inventor: Kazuhisa Aruga, Suwa, Japan

[73] Assignee: Seiko Epson Corporation, Tokyo, Japan

[21] Appl. No.: 08/876,787

[22] Filed: Jun. 16, 1997

Related U.S. Application Data

[63] Continuation-in-part of application No. 08/307,084, Sep. 16, 1994, Pat. No. 5,639,169, which is a continuation of application No. 08/065,731, May 21, 1993, abandoned.

[30] Foreign Application Priority Data

May 22, 1992 [JP] Japan ..... 4-130261

[51] Int. Cl.[7] ..... B41J 11/50

[52] U.S. Cl. ..... 347/193; 400/605; 400/61; 400/166

[58] Field of Search ..... 400/157.3, 605, 400/61, 166, 167, 157.2; 395/111, 112, 113, 114, 115; 347/171, 193

[56] References Cited

U.S. PATENT DOCUMENTS

| | | |
|---|---|---|
| 4,510,505 | 4/1985 | Fukui . |
| 4,687,356 | 8/1987 | Matsui . |
| 4,797,017 | 1/1989 | Okouchi . |
| 4,940,344 | 7/1990 | Wada . |
| 5,201,591 | 4/1993 | Ueda . |
| 5,214,750 | 5/1993 | Minowa . |
| 5,263,994 | 11/1993 | Ueda . |
| 5,398,305 | 3/1995 | Yuwata et al. . |

FOREIGN PATENT DOCUMENTS

| | | |
|---|---|---|
| 0395189 | 10/1990 | European Pat. Off. . |
| 53-118315 | 10/1978 | Japan . |
| 33118 | 8/1984 | Japan . |
| 255464 | 12/1985 | Japan . |
| 079678 | 4/1986 | Japan . |
| 263776 | 11/1986 | Japan . |
| 132063 | 6/1988 | Japan . |
| 23953 | 1/1991 | Japan . |
| 3-23953 | 1/1991 | Japan . |
| 93549 | 4/1991 | Japan . |
| 208074 | 9/1991 | Japan . |
| 115961 | 4/1992 | Japan . |
| 2219768 | 12/1989 | United Kingdom . |

*Primary Examiner*—Huan Tran

[57] ABSTRACT

A printer and control method for printing to various types of recording media store printing modes appropriate to those various types of recording media in a mode/media memory section. When a particular printing mode is selected while a particular type of recording media is selected, the correlation between that printing mode an recording media is stored. Whenever that type of recording media is subsequently selected for printing, the corresponding printing mode is automatically selected from memory to control the printing operation. It is therefore possible to select what printing mode is used with what recording media, and thereafter automatically select, by simply selecting the type of recording media, the printing mode that is most appropriate to the type of recording media, the thickness of the media, and other particular media specifications. Printing appropriate to the type of recording media is then possible by simply selecting the type of recording media used.

13 Claims, 12 Drawing Sheets

| RECORDING PAPER | MODE | |
|---|---|---|
| | A | B |
| ROLL PAPER | 0 | 1 |
| CUT-SHEET PAPER | 0 | 1 |

FIG.8A

| RECORDING PAPER | MODE | |
|---|---|---|
| | A | B |
| ROLL PAPER | 1 | 0 |
| CUT-SHEET PAPER | 0 | 1 |

FIG.8B

| RECORDING PAPER | MODE | |
|---|---|---|
| | A | B |
| ROLL PAPER | DON'T CARE | DON'T CARE |
| CUT-SHEET PAPER | 0 | 1 |

FIG.8C

PRINTER AND CONTROL METHOD THEREFOR

RELATED APPLICATIONS

This application is a continuation-in-part of U.S. patent application Ser. No. 08/307,084, filed Sep. 16, 1994, and will issue on Jun. 17, 1997 as U.S. Pat. No. 5,639,169, which in turn is a continuation of U.S. patent application Ser. No. 08/065,731, filed May 21, 1993, now abandoned.

BACKGROUND OF THE INVENTION

1. Field of the Invention

The present invention relates to printers for printing to various types of recording paper, such as roll paper and cut forms, and to a print control method therefor.

2. Description of the Related Art

When printing to roll paper, which is widely used for receipt printing, and when printing to cut forms supplied as single-sheet forms or multi-part carbon-copy forms for slip printing, the printing conditions vary according to the type of recording paper and such precise specifications required in the printer as the paper thickness and print density. A printer capable of handling roll paper is typically needed for receipt printing, and a printer equipped with a thermal print head is needed if the roll paper is heat sensitive paper. On the other hand, if cut forms are to be printed, then a printer capable of handling cut forms is needed, and if the cut form is a multi-part form, then a printer equipped with a wire dot print head is typically required. This has led to the development of or research into wire dot printers capable of supplying roll paper and cut forms, and printers equipped with a thermal print head for receipt printing and a wire dot head for slip printing, so that plural types of recording paper can be utilized.

In any case, the thermal print head or wire dot print head driving voltage is normally supplied from a common power source or supply such as an AC power source coupled to a switching regulator, a series regulator, or other type of DC stabilized control. Such stabilized power sources have internal impedance or resistance, and the output voltage changes with changes in the load applied to the output. In addition, because of the impedance characteristics wiring connecting the power source to the print head drive circuit, the driving voltage supplied to the print head drive circuit is often not fixed but fluctuates to some extent. Therefore, assuming a constant length of time for the application of the driving voltage to the print head, the energy delivered to the print head does not remain constant, resulting in a certain level of unevenness in the printing output quality which may be discerned by the user.

In order to make the energy imparted to the print head constant, a control method that varies the print head driving time such that the print head is driven for a longer period of time when the voltage is low, and the print head is driven for a shorter period of time when the voltage is high, is known. A graphical representation of the relationship between print head driving voltage and driving time is presented in FIG. 12.

From FIG. 12 it is readily apparent that the relationship between the driving period T1 to the driving voltage V1 has a roughly 1-to-1 correlation. By controlling the print head so that the print head driving time is more suited to the print head driving voltage, printing quality can be stabilized.

Unfortunately, this simple type of stabilization does not apply as well to printers that are capable of accommodating multiple types of print media or paper. That is, when the thickness and material of the recording paper being used varies, it is difficult to consistently obtain high print quality using the above method of matching driving voltage to driving time using a functional relationship. For example, the print head driving time can be relatively short with roll paper because it is a single sheet of paper, but when multiple layers of paper are used, as for multi-part forms and copies, the print head driving time must be increased to ensure proper recordations. When the printer has only one print head driving mode, however, the print head operates for the same print head driving time at a same given print head driving voltage. This means that if print head driving is set for multi-part forms, the print head driving time for roll paper becomes longer than necessary, causing such problems as increased printing noise and print head overheating. On the other hand, if print head driving is set for single sheet paper, the driving time is shorter than what is required for multi-part forms, and the ability to make copies is severely degraded.

In order to solve these problems, printers are being developed which control the length of time voltage or power is applied to the print head according to the relative thickness of the recording paper being used. Examples of such printers are found in Japanese Laid-Open Patent Publications 53-118315, 03-23953 and 03-93549.

The printer disclosed in 53-118315 is provided with a detector for sensing the presence of a paper thickness indicator affixed to the recording paper, and a magnet energizing time indicator signal which corresponds to the paper thickness. This signal is used to automatically determine the thickness of the recording paper and control the print magnet energizing current and print head driving time according to the sensed paper thickness.

The printer disclosed in 03-23953 has a special gap motor which is used to adjust the, gap between the printer platen and the print head, and a gap sensor to determine the current size of this gap. By measuring the difference in gap size between the point when no recording paper is present and when recording paper is present on the platen, a relative thickness for the recording paper is determined. From this determination of paper thickness, the length of time for driving the print head is selected.

The printer disclosed in 03-93549 also has a motor which is used to adjust the platen gap, along with a sensor for determining the maximum physical gap size for the printer. By measuring the distance by which the print head is moved from the maximum open gap configuration until it contacts the recording paper, such as by monitoring the rotation of the motor, the thickness of the recording paper can be detected. Once the thickness is measured, the length of time over which power is applied to the coils to drive print head pins is adjusted accordingly.

However, the printers disclosed in each of these publications require a special mechanism to detect the thickness of the recording paper. That is, in '315 publication, a paper thickness indicator affixed to the recording paper along with an associated detector are contemplated. For the printers disclosed in the '953 and '549 publications, both a platen gap adjustment motor and an associated gap sensor are required. As a result, it is easy to achieve high quality printing with particular types of recording paper because the print head driving voltage and print head driving time are automatically adjusted according to the paper thickness. It should be recognized, however, that these printers cannot accommodate differences in the printing, modes for single sheet paper and multi-part forms, or the printing modes for two color thermal paper that is heated one temperature to print black and another temperature to print red, for example. Further, conventional printers also cannot accommodate the different print head driving voltages and print head driving times required for multi-part forms and single sheet forms of the same thickness.

The aforementioned conventional printers are therefore unable to accommodate plural types of recording paper, and are even unable to generally accommodate the same type of recording paper because the precise characteristics of the paper may vary depending on recording material quality and manufacturing techniques employed, as is well known in the art. In fact, providing such specialized mechanisms conversely complicates the mechanical configuration of the printer, thus leading to degraded reliability and ease of assembly, and increasing production costs in a market known for strong price competition between products.

OBJECTS OF THE INVENTION

The object of the present invention, therefore, is to provide a printer which is capable of printing to plural types of recording paper and can easily set the printing mode for a particular type of paper, and more particularly can set the printing mode for the different specific characteristics of the recording paper. A further object is to provide a printer which can easily print to different types of recording paper in a printing mode suitable for that recording paper.

SUMMARY OF THE INVENTION

In order to achieve these and related objects, a printer for selecting and printing plural types of recording paper according to the present invention comprises memory for storing printing modes and associated characteristics various types of recording paper, a paper selector for selecting the type of recording paper to be printed on, and a mode selector for selecting the desired printing mode. The printing modes selected by this mode selector are stored in local memory with a correspondence to the type of recording paper selected by the paper selector. Printing to the type of recording paper selected by the paper selector is thereby made possible by accessing the corresponding printing mode stored in memory.

A method of controlling a printer for selecting and printing to any of different types of recording paper according to the present invention includes a step for selecting the type of recording paper to be printed on, and a step for selecting the printing mode. The printing modes selected by the mode selection step are stored in memory having a specific correspondence to the types of recording paper selected by the recording paper selection step. This makes it possible to print on the type of recording paper selected by the recording paper selection step using the stored printing mode corresponding to that type of recording paper.

According to the present invention, the user can select the appropriate printing mode for driving the print head by merely specifying which recording media is to be used for printing. It is therefore not necessary to separately specify the type of recording paper and the printing mode with the printer and control method therefor according to the present invention, the printing mode appropriate to the type of recording paper is automatically selected, and stable, high quality printing is achieved.

For example, if the driving mode (printing mode) corresponding to a particular recording medium (printing paper) is at first not optimal, the user can select the printing mode appropriate to that recording paper. Once the printing mode is thus set, the optimum printing mode can be selected by simply selecting the type of recording paper.

Alternatively, confronted with plural print modes (each mode specifying an unique combination of head driving voltage and driving times) the user may override default mode parameters specified for the supported recording media and instead select what the users perceieves as being the optimal print mode for a given medium. For example, if the user performs a print test using a certain type of recordings paper and selects a particular printing mode as the best for that type of recordings paper, that printing mode is automatically registered as the printing mode corresponding to that type of recording paper.

Thus, when a particular type of recording paper is selected, the printer and control method of the present invention permit automatic selection of the printing mode previously determined by the manufacturer on the use to be suitable to that particular type of recording paper. It is therefore possible to provide a printer that can automatically accommodate different types of recording paper without requiring a mechanism for automatically determining the recording paper and setting the corresponding print mode. Such auto sensing mechanisms and supporting circuitry, as well as the space and costs required therefor are therefore not needed, and it is therefore possible to provide a compact, high reliability, low cost printer whereby a printing mode appropriate to the type, thickness, and other particular specifications of the recording paper is automatically selected when the type of recording paper changes. It is also possible to provide a printer with good general utility because printing modes for different types of recording paper can be set by the user.

It should be noted that the printer of the present invention need not be limited to being able to print to only two types of recording paper. However, if, by way of example only, the printer comprises a printing section for printing to a first type of recording paper and a second type of recording paper that differs in type from the first type of recording paper, the printing section can be configured to print using a printing mode stored in memory for the first type of recording paper when the paper selector selects the first type of recording paper, and to print using a printing mode stored in memory for the second type of recording paper when the paper selector selects the second type of recording paper.

Furthermore, the printer can comprise plural printing sections corresponding to the different types of recording paper. For example, a first printing section can be used for printing to a first type of recording paper and a second printing section can be used for printing to a second type of recording paper that differs in type from the first type of recording paper. In this case, printing modes are stored corresponding to the first and second printing sections for printing to different types of recording paper. When the first or the second printing section is then selected, it is possible to print using the printing mode stored for the selected printing section. It is, of course, also possible for the printing modes to be stored corresponding to the type of recording paper.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference symbols refer to like parts:

FIGS. 8A, 8B, and 8C show examples of the correlations stored in the mode and paper memory 53 shown in FIG. 1;

DESCRIPTION OF THE PREFERRED EMBODIMENTS

Figure 1:
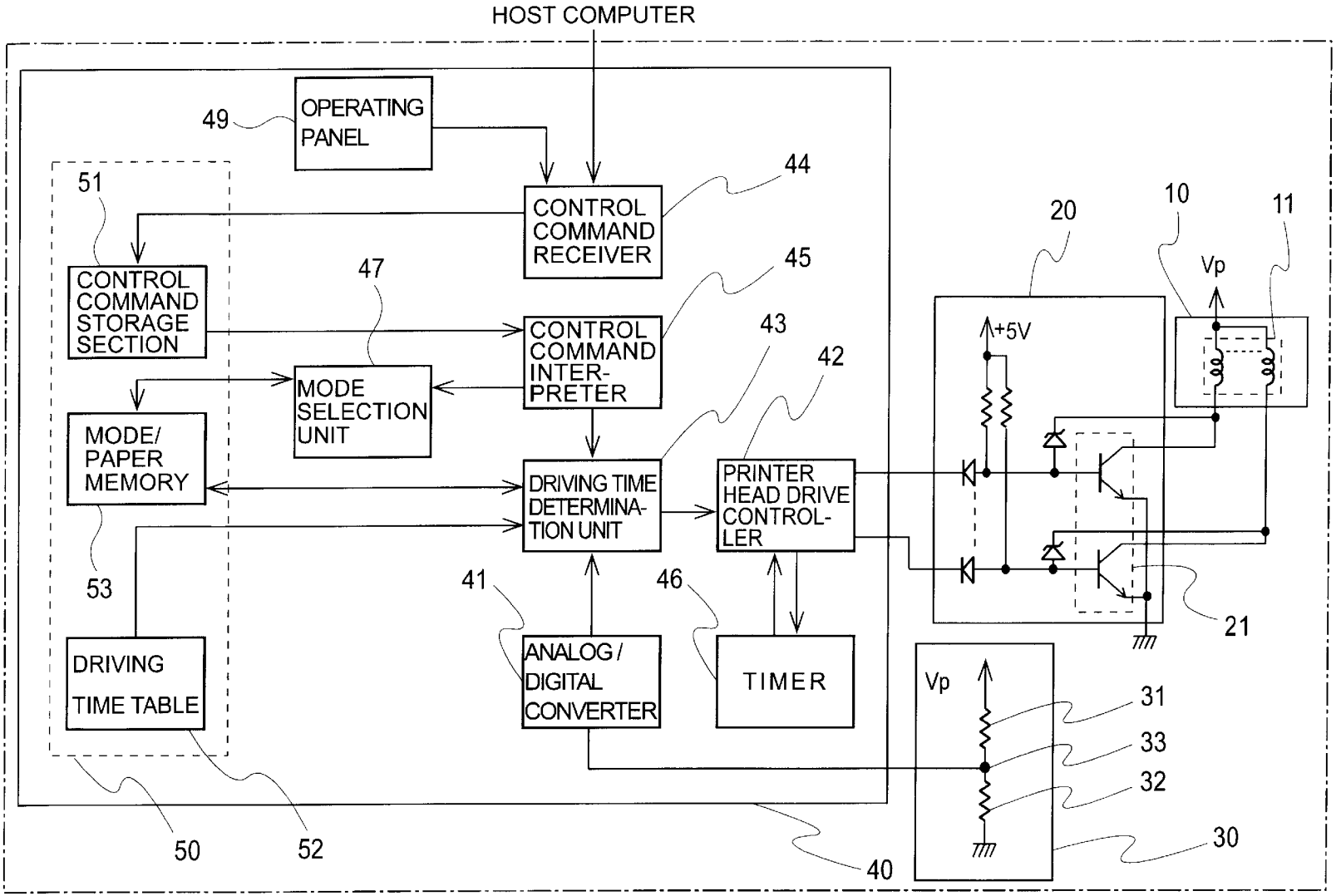
FIG. 1 is a block diagram of a printer according to the first embodiment of the invention.

A first embodiment of a printer constructed and operating according to the principles of the invention is shown in FIG. 1. The printer in FIG. 1 uses a wire dot print head 10 for printing to both roll paper and cut forms. The printer 1 therefore includes a print head voltage measurement section 30 for measuring the voltage Vp supplied to the head coil 11 of print head 10, a printer control circuit 40 for printing control and communicating control commands, and a print head driver 20 used to provide and control voltage supplied to head coil 11 based on command signals issued by printer control circuit 40.

Print head driver 20 has an output drive switch 21 which applies the desired print head driving voltage Vp to head coil 11. An exemplary drive switch 21 comprises one or more power transistors. The print head 10 comprises dot wires (not shown) for wire dot printing. Therefore, when drive switch 21 is switched to an ON state by a control signal from printer control circuit 40, print head driving voltage Vp is applied to each designated head coil 11 as desired. The application of voltage to coils 11 causes the dot wires to be driven by actuators comprising magnetic circuits, which are not shown, and dot matrix printing to be performed as is known in the art.

Driving voltage measurement section 30 senses or measures fluctuations that occur in the magnitude of driving voltage Vp being applied to head coils 11. To this end, voltage measurement section 30 uses two reference resistors 31 and 32 with one end of reference resistor 31 connected to the source of print head driving voltage Vp, while the other end is connected to one end of reference resistor 32. The other end of reference resistor 32 is connected to a ground potential. Therefore, a voltage divider circuit is formed by reference resistors 31 and 32, and fluctuations in print head driving voltage Vp are measured as changes in a voltage output at a divider node or measurement point 33, and transferred to printer control circuit 40.

In this embodiment, printer control circuit 40 uses a lower voltage power source which is separate from and operates independently of the power source that generates driving voltage Vp. Therefore, the type of voltage divider circuit described above is necessary. Also, by using a voltage divider circuit, the impedance of the side being measured can be increased, which provides a measure of protection for the measurement circuit. Furthermore, the integrating circuit formed by the input capacitance of the measuring. side and the resistance of the voltage divider circuit acts to remove the impact of any high frequency noise component contained within the driving voltage Vp signal.

Printer control circuit 40 includes a control command receiver 44, which is used to receive control commands output from the host computer, and a control command interpreter 45, which is used to decode and interpret the meaning or operational function of control commands being received. A memory unit 50 includes a control command storage section 51 where the control commands received by the control command receiver 44 are temporarily stored. After control commands are received and stored, control command interpreter 45 fetches the stored commands from control command storage section 51, interprets the function of each control command, and determines the type of recording paper, the print head driving mode, etc., which are to be used according to the function specified by each command.

The printer 1 of the present embodiment also comprises an operating panel 49 for user control of certain operations that can be interpreted by control command interpreter 45 directly.

Printer control circuit 40 employs an analog-digital converter 41 for converting, the analog value measured by print head voltage measurement section 30 to a digital output value, and receives the divided voltage level of print head driving voltage Vp after digital conversion.

Printer control circuit 40 also has a mode selection unit 47, which stores the print head driving modes interpreted by control command interpreter 45 in mode/paper memory 53 with a specific correlation to the type of recording paper selected at that time, and a driving time determination unit 43, which is used to determine the driving time for print head 10 from the voltage-divided print head driving voltage Vp according to the print head driving mode set by mode/paper memory 53 according to the type of recording paper interpreted by control command interpreter 45. The printer control circuit 40 also comprises a print head drive controller 42, which controls print head driver 20 according to the time values supplied by driving time determination unit 43.

Figure 2:
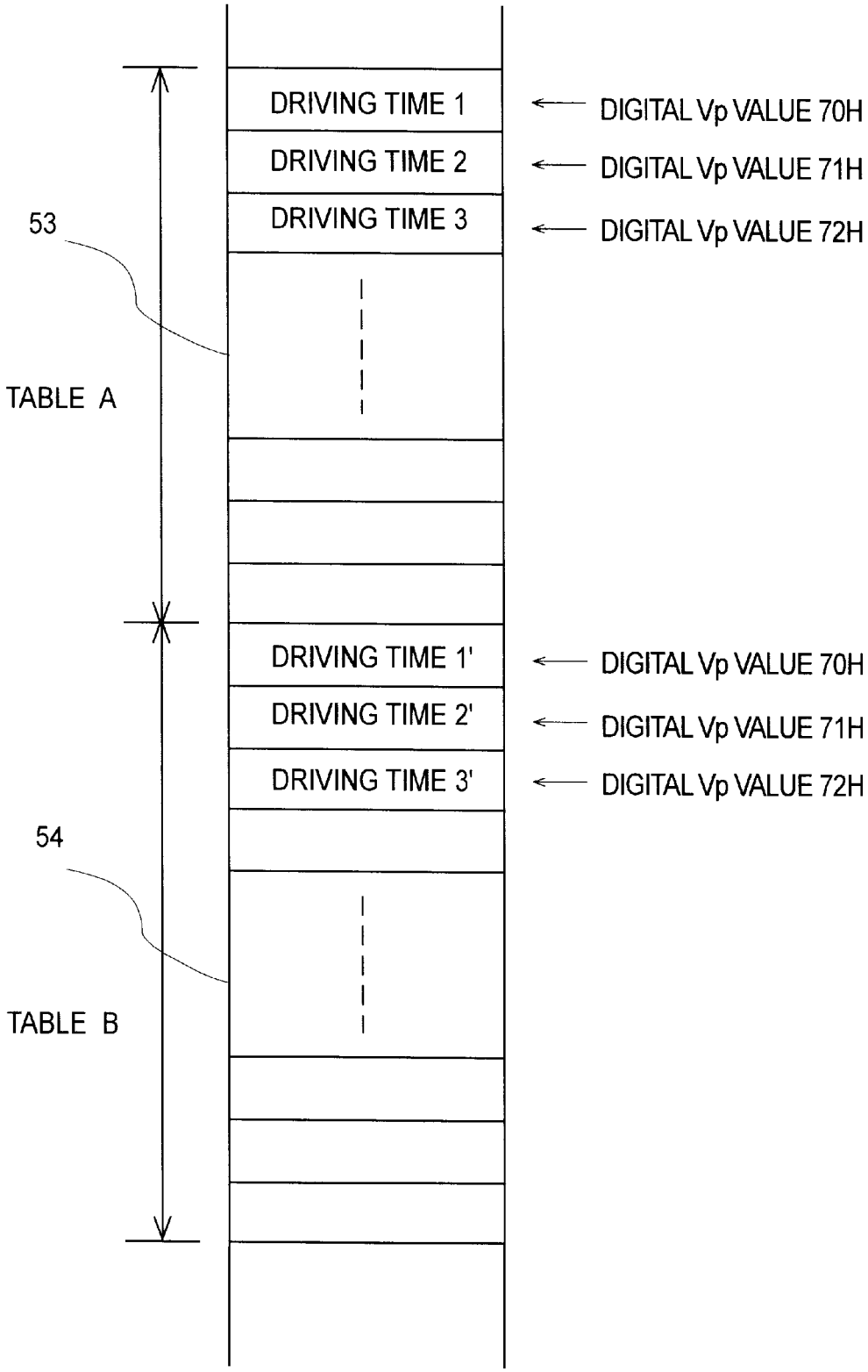
FIG. 2 is a graphical representation of the driving time for the printer shown in FIG. 1.
Figure 3:
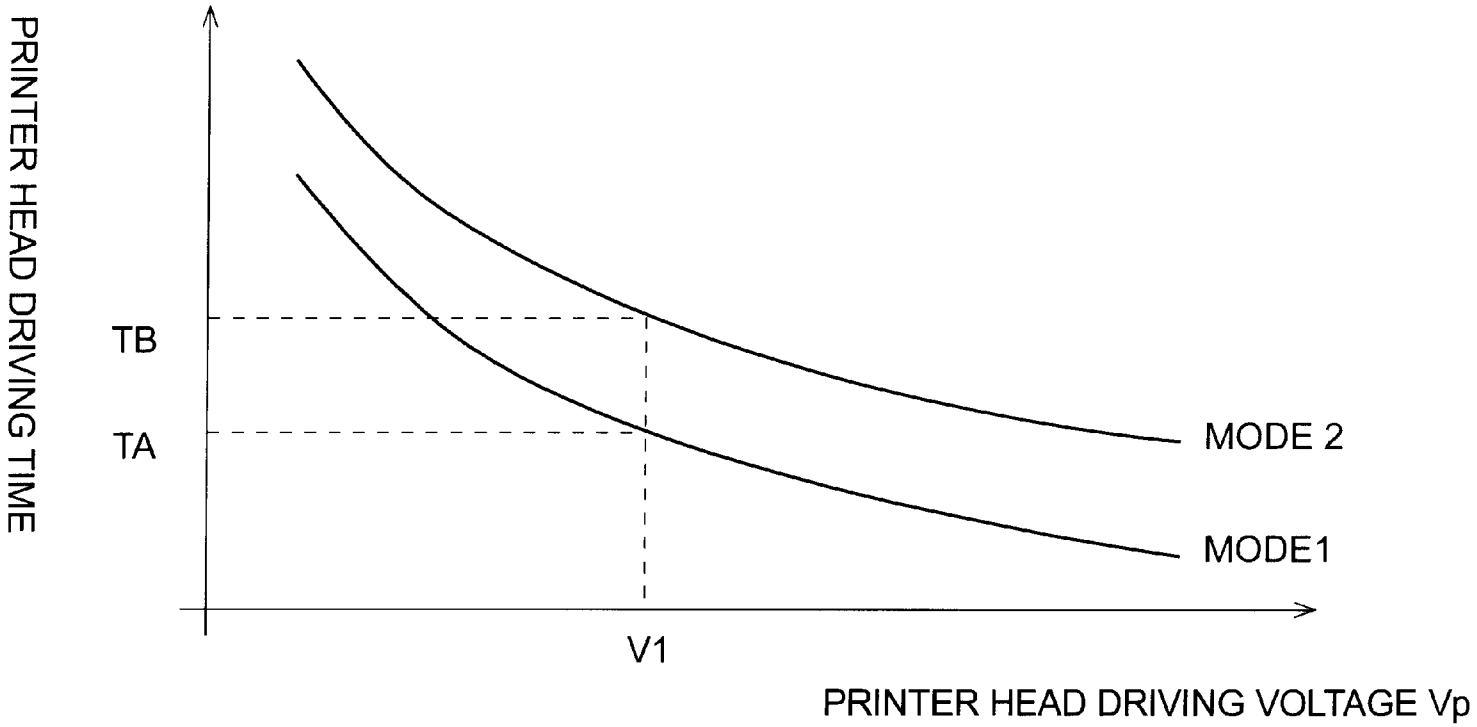
FIG. 3 is a graphical representation of the relationship between print head driving time and applied voltage used to calculate the driving time tables shown in FIG. 2.

Memory 50 also has driving time table memory 52 for storing print head driving voltage Vp and print head driving time for each of the print head driving modes. In this exemplary embodiment, driving time table 52 is used to store two tables of print head driving time values, a table A storing time values for driving mode A and a table B storing time values for driving mode B, as shown in FIG. 2 and described in more detail hereinbelow. The relationship between print head driving voltage Vp and the print head driving times TA (the driving time in mode A) and TB (the driving time in mode B) stored in tables A and B, is shown in FIG. 3 also to be described in more detail hereinbelow.

Figure 12:
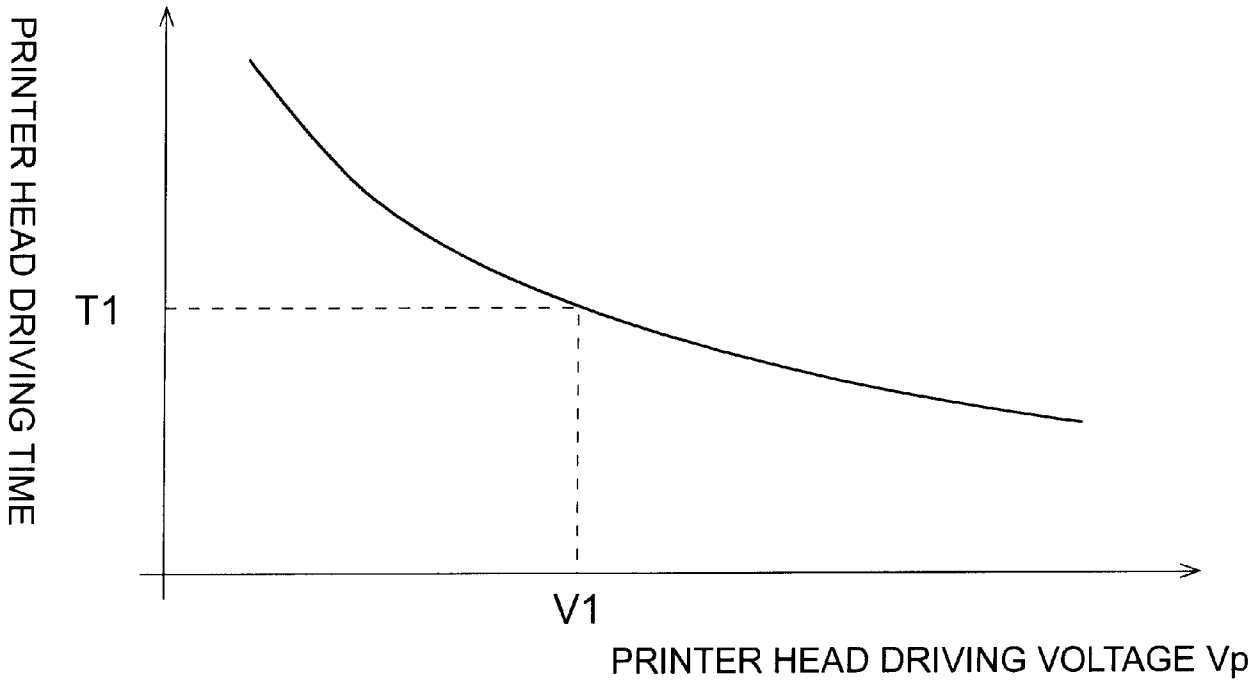
FIG. 12 is a graphical representation of the typical relationship between print head driving time and applied voltage.

The relationship between driving times TA and TB for the respective modes and driving voltage Vp is as previously described with reference to FIG. 12. As is obvious from the figure, driving time TB selected in mode B is longer than driving time TA selected in mode A at the same driving voltage V1. The digitally converted values of print head driving voltage Vp (in this embodiment, the voltage-divided values), and the corresponding optimum print head driving time, are stored for each driving mode in driving time table memory 52 shown in FIG. 2 according to the graph in FIG. 3.

Driving time determination unit 43 uses the values stored within driving time table memory 52 to establish a desired print head driving time which is set or stored in a timer 46. The time set in timer 46 is determined based on a voltage-divided divided value of print head driving voltage Vp, and the particular print head driving mode as determined with reference to mode/paper memory 53 and the type of recording paper interpreted by control command interpreter 45.

An (exemplary control command for selecting the print head driving mode and type of recording paper that has been found useful for implementing the invention is described below. The driving mode selection command for printer 1 according to the present embodiment is $$\text{GS E}n \tag{1}$$

where command code "GS E" is used to indicate that the command is a command designating a print head driving mode selection. When control command interpreter 45 reads command code "GS E", it interprets it as a command for selecting the print head driving mode specified. "GS" represents the ASCII code group separator (GS); i.e., it indicates a number or code value 1DH (where H is used to indicate that a hexadecimal number is being used) and "E" indicates an ASCII code 45H. The command argument "n" indicates or specifies the print head driving mode being designated by the command. The value or values expressed by "n" can be predefined in several ways, as known to those skilled in the art. However, for purposes of illustration, in the present embodiment, when n=0, a mode A is selected and when n=1, a mode B is selected. However, "n" can be assigned many values, each of which is used to select a different printing mode.

As described above, in this embodiment, for a given print head driving voltage, mode A uses a shorter print head driving time than mode B. That is, assuming that when print head driving voltage Vp equals V1, the print head driving time of mode A with respect to V1 is TA, and the print head driving time of mode B is TB, and $$TA<TB. \tag{2}$$

While parameter "n" was illustrated above as being configured as a single byte value, this is not a limitation of the present invention. This parameter or command argument can be configured to occupy two or more bytes of data, as required. Also, only two driving modes, designated as A and B, were used to illustrate this embodiment for purposes of clarity, but this should not be viewed as a limitation of the invention, and it is possible to use any number of driving modes, as desired for specific applications.

An example of the control command used by the invention for selecting the type recording paper to be used is $$\text{ESC } c0n \tag{3}$$

where command code "ESC c0" indicates that this command is a recording paper selection command, and when control command interpreter 45 reads this command code, it interprets a subsequent command argument as a particular recording paper selection. The "ESC" character represents the ASCII code escape; which indicates 1BH, and the "c0" characters represent ASCII codes 63H and 30H, respectively. The following code parameter "n" specifies the specific recording paper. That is, as before, values for "n" are predefined so that when n=0, roll paper is selected, and when n=1, cut-sheet paper is selected, though it will also be obvious that the invention need not be limited to these values.

The above parameter was configured as one byte, but it may be two or more bytes as required. In addition, only two types of paper, roll paper and cut-sheet paper, were used in this embodiment for purposes of clarity in designating the print media. However, this should not be viewed as a limitation of the invention and the values for "n" can be determined according to the required number of recording media or paper types used for the specific application desired for the printer.

An explanation of the method of controlling a printer constructed according to the first embodiment is presented next. As already explained, the control command sent from the host computer is received by control command receiver 44 of the printer control circuit and is stored in command storage section 51 of memory 50.

Figure 4:
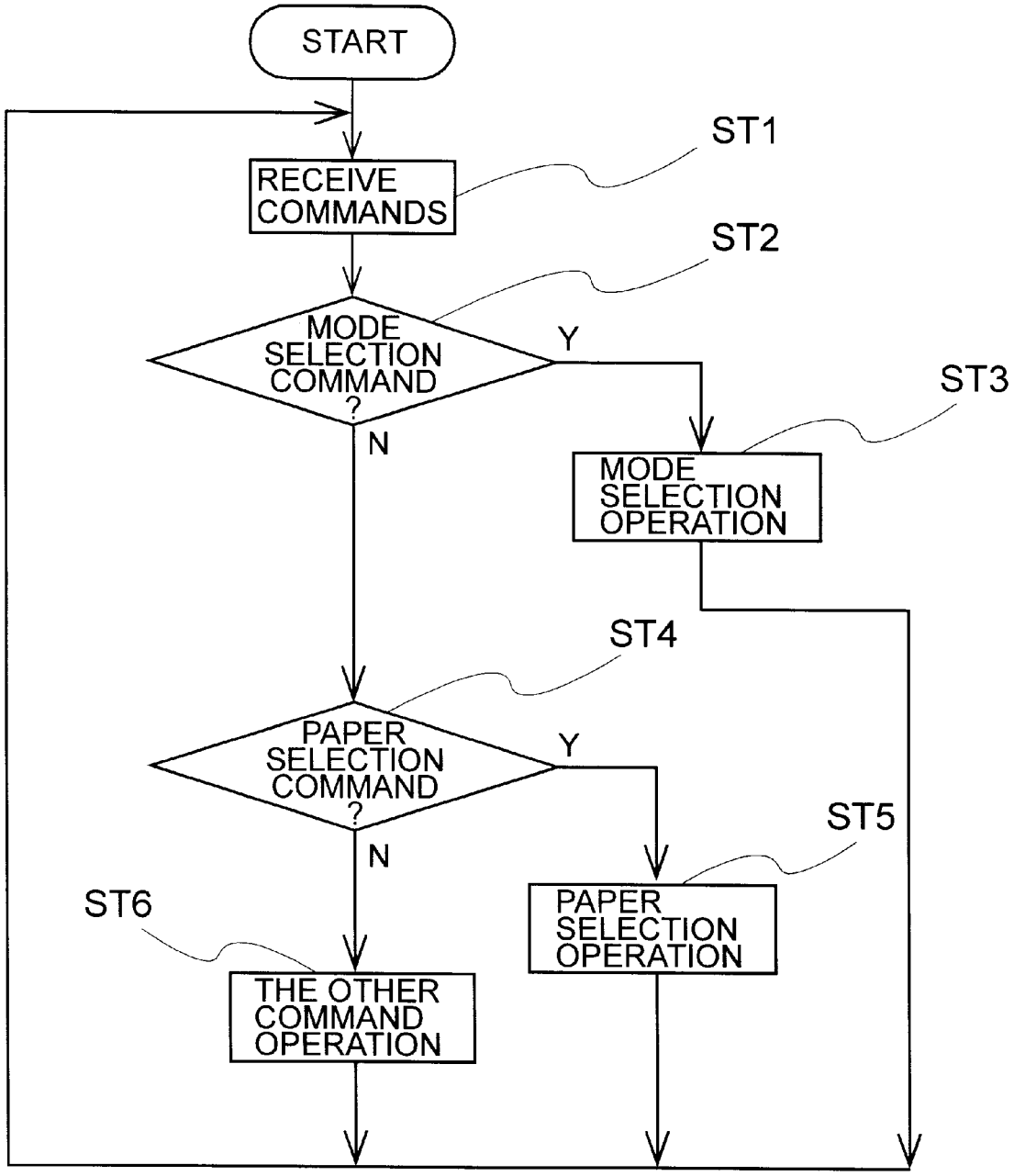
FIG. 4 is a flowchart of steps implemented in operating the printer of FIG. 1.

In FIG. 4, the control command interpreter 45 first reads out the control command from control command storage section 51 in a step ST1, and then determines, whether or not this control command is a driving mode selection command, in step ST2. If the control command is a driving mode selection command, then control passes to step ST3 where a determination is also made as to which print head driving mode should be selected. The process for this print head driving mode determination is described in more detail below referring to the flow chart shown in FIG. 5.

If, however, it is determined in step ST2 that the command being read is not a driving mode selection command, a subsequent determination is made as to whether or not it is a recording paper selection command in step ST4. If it is, a determination as to which type of recording paper is being specified by the command is then made in step ST5. The process for this recording paper determination is described in more detail below referring to the flow chart shown in FIG. 6.

If, however, it is determined in step ST4 that the command is not a recording paper selection command, then the command is not a control command for driving mode selection and processing proceeds to a step ST6 where commands other than those for driving mode selection are executed according to their respective conventional command function. Examples of this latter type of control command include a line feed control command ("LF") or a printing data cancel control command ("CAN").

Figure 5:
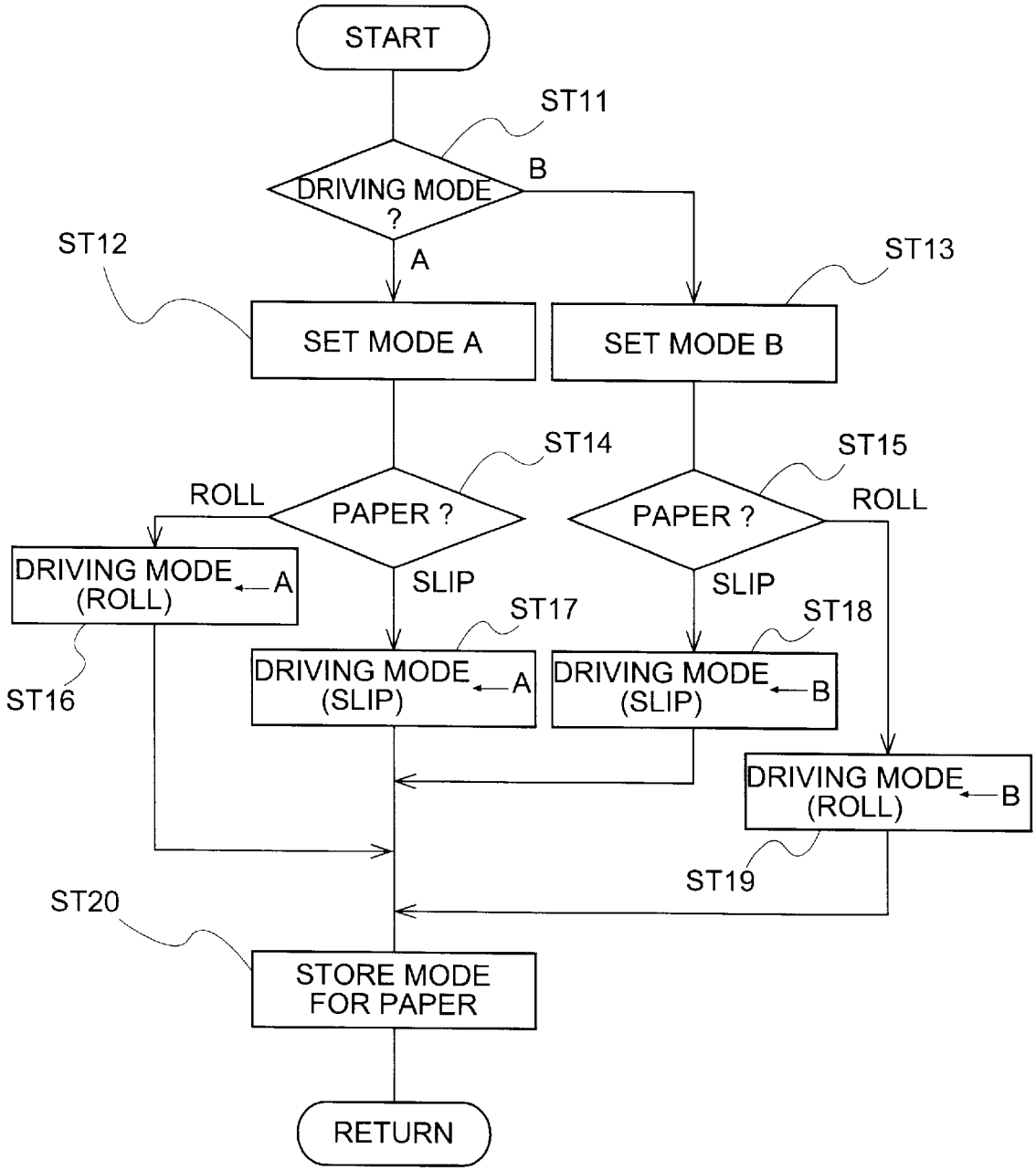
FIG. 5 is a flowchart of the steps in the mode selection operation shown in FIG. 4 according to the first embodiment of the invention.

Referring now to FIG. 5, the sequence of steps for determining the print head driving mode (step ST3 in FIG. 4) is described next. The first step in this sequence, step ST11, interprets the mode selection control command "GS E n." Because a parameter "n" value of 0 in printer 1 according to the present invention designates print head driving mode A as described above, driving mode A is selected, in step ST12, if n=0. Likewise, driving mode B is selected, in step ST13, if n=1. Note that interpretation of these control commands is performed by control command interpreter 45, and the succeeding processing to the interpretation is then performed by mode selection unit 47.

What recording paper (printing paper) is currently selected is then determined in step ST14 or ST15 depending on whether mode A or mode B has been previously set. This determination can be made based on the current paper type selection information in control command interpreter 45 or driving time determination unit 43. It is also possible to store the information in mode/paper memory 53, and make the determination based on this information.

Once it is determined what type of paper has been selected, the driving mode selected according to the selected paper type is set. If the recording paper specified by the control command is roll paper and driving mode A is selected based on the driving mode selection control command, then driving mode A is set as the driving mode for roll paper in step ST16. On the other hand, if, in step ST17, driving mode A is selected based on the driving mode selection control command after cut form paper is selected, then driving mode A is set as the driving mode for cut forms. In either case, the driving mode selection for the particular type of recording paper is then stored in step ST20. Driving mode B is likewise set for cut forms in step ST18, and for roll paper in step ST19, and the correlation between the mode setting and the selected paper type is then stored to mode/paper memory 53 in step ST20.

Some possible examples of the correlations between driving modes A and B and the type of recording paper (roll paper and cut forms in this example) are shown in FIGS. 8A–8C. The default correlations between driving mode and the type of recording paper in the printer of the invention are shown by way of example only in the table in FIG. 8A. As shown in the table, the driving mode with the longer print head driving time is automatically selected by default to assure positive printing no matter what type of recording paper is selected when no particular driving mode setting is made. On the other hand, if the driving mode setting sequence is run when roll paper is selected and driving mode A is selected, then the roll paper driving mode setting is changed from B to A as shown in FIG. 8B, and this correlation is stored. Once this setting is made and stored, driving mode A is automatically used for printing anytime thereafter that roll paper is selected. As will also be obvious from the flowchart, if driving mode A is selected using the driving mode selection control command when a cut form is selected, driving mode A can be automatically selected for cut forms.

Moreover, a setting in which changing the driving mode according to the type of recording paper is not permitted is also possible. An example of this is shown in FIG. 8C where a driving mode selection cannot be made for roll paper.

Figure 6:
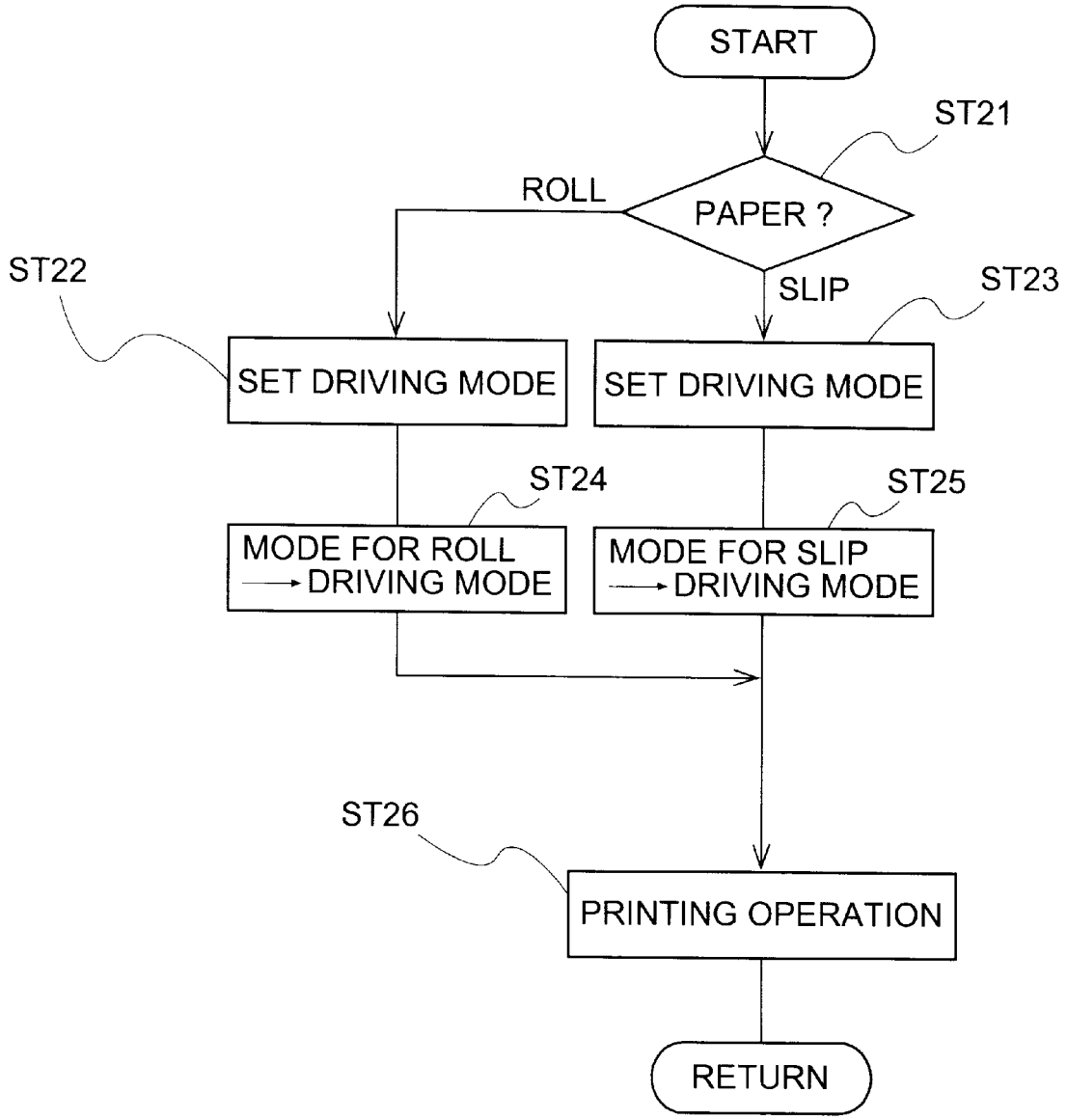
FIG. 6 is a flowchart of the steps in the paper selection operation shown in FIG. 4 according to the first embodiment of the invention.

The sequence of steps used for processing the recording paper selection command (ST4 in FIG. 4), is shown in more detail in the flowchart of FIG. 6 and described below.

The first step in this sequence is to interpret the recording paper selection command "ESC c0 n" in step ST21. Because a parameter "n" value of 0 in printer 1 according to the present invention designates roll paper as described above, the printer 1 is set to a roll paper printing mode, in step ST22, if n=0. More specifically, processing is performed in step ST22 that switches any recording paper transport path or driving mechanism in the printer to a state or mode required for roll paper, or sets the amount by which the recording paper is advanced through the printer for any line feed commands to a value corresponding to the specified roll paper. The driving mode is then set in step ST24 by fetching the driving mode corresponding to the selected type of recording paper, which in this case is roll paper, from mode/paper memory 53. If the exemplary driving mode settings shown in FIG. 8B are stored, then driving mode A will be set in step ST24.

On the other hand, if n=1 in step ST21, then the printer 1 is set to a cut form printing mode in step ST23, and the driving mode stored in mode/paper memory section 53 for cut forms is subsequently fetched and set as the cut form driving mode in step ST25. Again, if the exemplary driving mode settings shown in FIG. 8B are stored, then driving mode B will be set in step ST25. This is done because cut-sheet paper is often copy-type paper and print head driving mode B, which has a longer driving time, is selected to ensure sufficient print quality for all layers of the multi-layered "copy" media. Note that interpretation of these control commands can be performed by control command interpreter 45, or control command interpreter 45 can simply interpret that the command is a mode selector control command with mode selection unit 47 then interpreting what mode is to be selected.

Once a driving mode has thus been specified for a particular type of recording paper (printing media), a printer 1 according to the present invention automatically selects the most appropriate driving mode when the recording paper is selected. The printing operation is then executed in step ST26 controlled by the selected driving mode.

Figure 7:
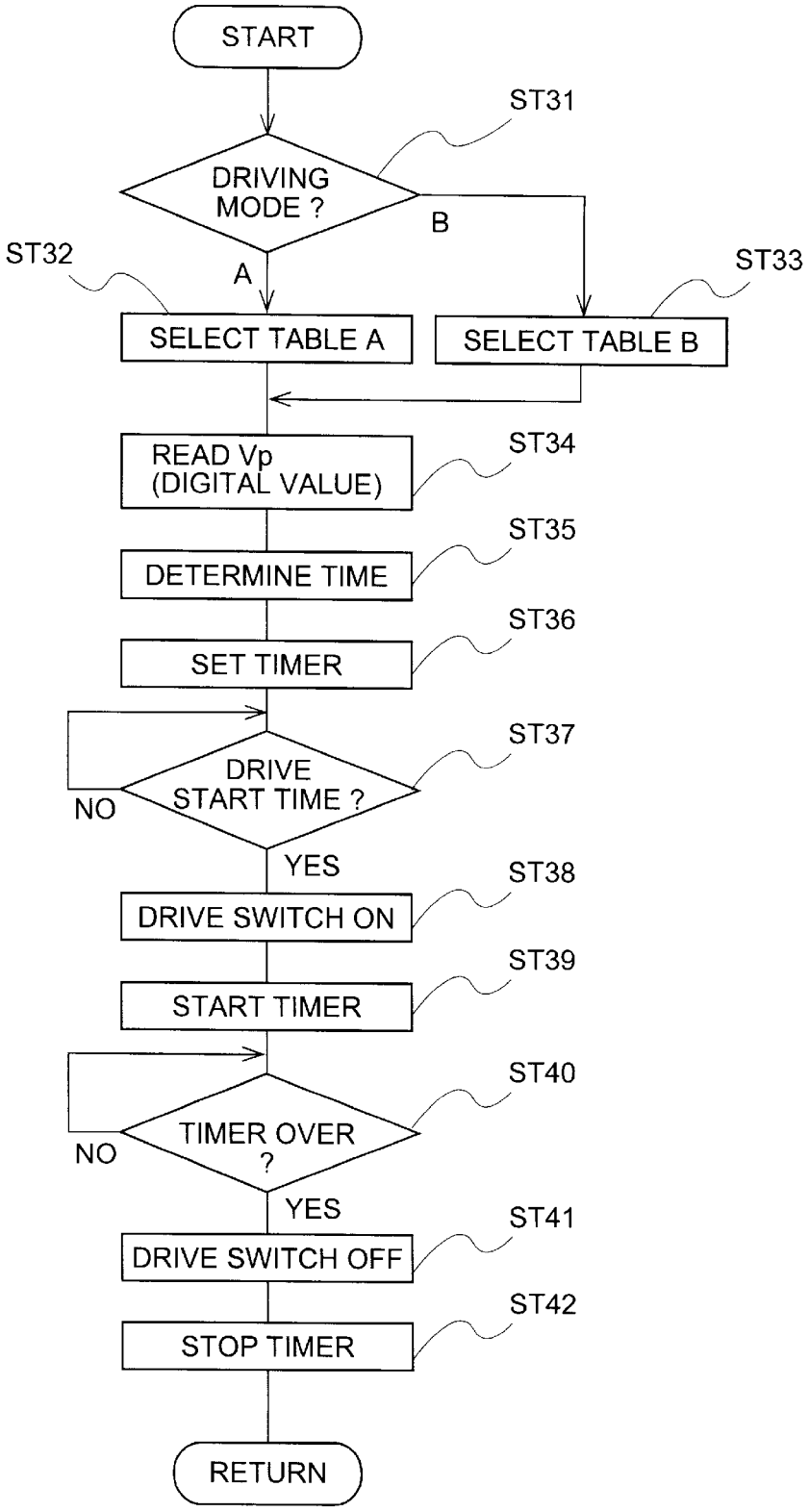
FIG. 7 is a flowchart of one example of the printing operation shown in FIG. 6.

An exemplary printing operation executed by a printer 1 according to the present embodiment is described next below with reference to the flowchart of FIG. 7 showing the operation ST26 employed to print a single dot.

At the first step, step ST31 shown in FIG. 7, the print head driving mode set for the selected paper is determined. If the driving mode is mode A, then table A is fetched from driving time table memory 52 in step ST32, and if the print head driving mode is mode B, then table B is fetched from driving time table memory portion 52 in step ST33. The value of the print head driving voltage Vp (divided voltage value) digitally converted by analog-digital converter 41 is then fetched, in step ST34, from the selected table A or B.

The print head driving time corresponding to the digital value fetched in step ST34 from the table A or B selected in step ST32 or 33, is calculated in step ST35 and sent to timer 46 in a step ST36. The sequence then waits, in step ST37, for the periodic operating timing of the print head 10 to cycle.

When the operating timing for print head 10 cycles or restarts, print head drive controller 42 transfers the driving signal to print head driver 20, in step ST38, and timer 46 begins to run in step ST39. The sequence of steps to this point switches drive switch 21 to an ON state, and begins applying print head driving voltage Vp to the designated head coil 11 as desired, and thus printing starts. The timer is then monitored, in step ST40, to determine when the set driving time has expired. When the print head driving time is over, supplying the driving signal to print head driver 20 stops, in step ST41, and timer 46 stops, in step ST42. This completes the single dot printing sequence according to this embodiment.

With printer 1 and the control method according to the present embodiment described with reference to the accompanying flowcharts hereinabove, a printing mode (driving mode) which has been previously defined as appropriate for a particular type of recording paper is thereafter automatically selected whenever the corresponding type of recording paper is selected for printing. It is therefore possible to automatically accommodate various types of recording paper and print using the most appropriate driving mode without providing the printer with a mechanism for automatically evaluating the recording paper and selecting a corresponding printing method. Furthermore, it is not necessary to reset the driving modes every time the type of recording paper changes. The procedure for selecting the type of recording paper and starting printing can thus be simplified, and the processing time can also be shortened.

It is moreover possible to automatically set the printing mode for a particular recording paper without using sensors or other mechanical means or circuits to automatically detect the type of recording paper. Such mechanisms and circuits themselves, and accordingly the space otherwise required therefor are therefore no longer needed. A compact, high reliability, low cost printer which can print with high quality to plural types of recording paper can therefore be provided. The printing modes used for different types of recording paper can also be set by the user, thus significantly increasing the general utility of the printer according to the present invention.

Figure 9:
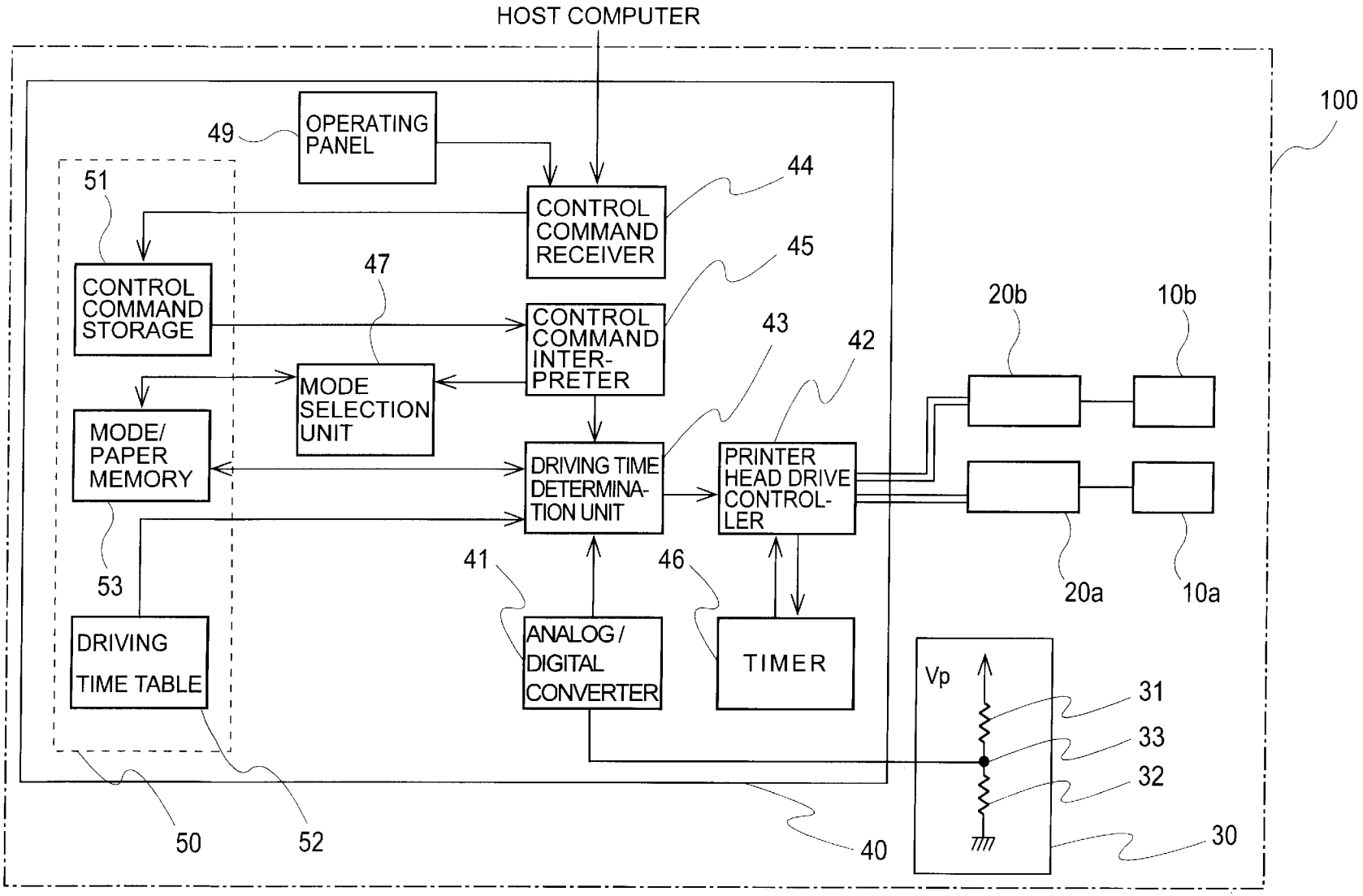
FIG. 9 is a block diagram of a printer constructed according to the second embodiment of the invention.

A printer 100 according to a second embodiment of the present invention is shown in FIG. 9 and described below. The printer 100 of this embodiment is substantially identical to the printer 1 of the first embodiment and described with reference to FIGS. 1–8C above. Common parts are therefore indicated with the same numbers, and further description thereof is omitted hereinbelow.

The printer 100 of this embodiment has two pairs of print heads 10*a*, 10*b* and print head. drivers 20*a*, 20*b*. One print head 10*a* and print head driver 20*a* pair is a wire dot print head, and is used for slip printing to cut forms. This exemplary print head 10*a* can be set to one of three printing modes as follows: a multi-part form mode (mode A), a thick cut-form mode (mode B), and a thin cut-form mode (mode C). Driving time tables such as those shown in FIG. 8 are stored in driving time table 52 of memory 50 for each of these driving modes A–C.

The other print head 10*b* is a thermal print head, and print head driver 20*b* is a corresponding driver. This print head 10*b* and print head driver 20*b* is used for receipt printing to roll paper. Yet more particularly, this print head 10*b* is for printing to, heat-sensitive recording paper coated with dye capsules in plural colors (black and red for purposes of this illustration) where the capsules are activated by different temperature levels. This print head 10*b* can therefore be set to one of four printing modes as follows: a mode for printing black (mode A), a mode for printing red (mode B), a mode for printing dark (mode C), and a mode for printing light (mode D). The temperature of the print head can be controlled during printing to change the, print color by controlling the effective supply power, for example, the driving voltage. The darkness (density) of printing can be adjusted by controlling the energizing time (driving time). Substantially the same mechanism described above for controlling a wire dot print head can therefore be used to control this print head 10*b* in these printing modes A to D. Tables of parameters corresponding to these printing modes A to D are therefore stored in table 52 of memory 50 as described above and likewise fetched as needed.

Figure 10:
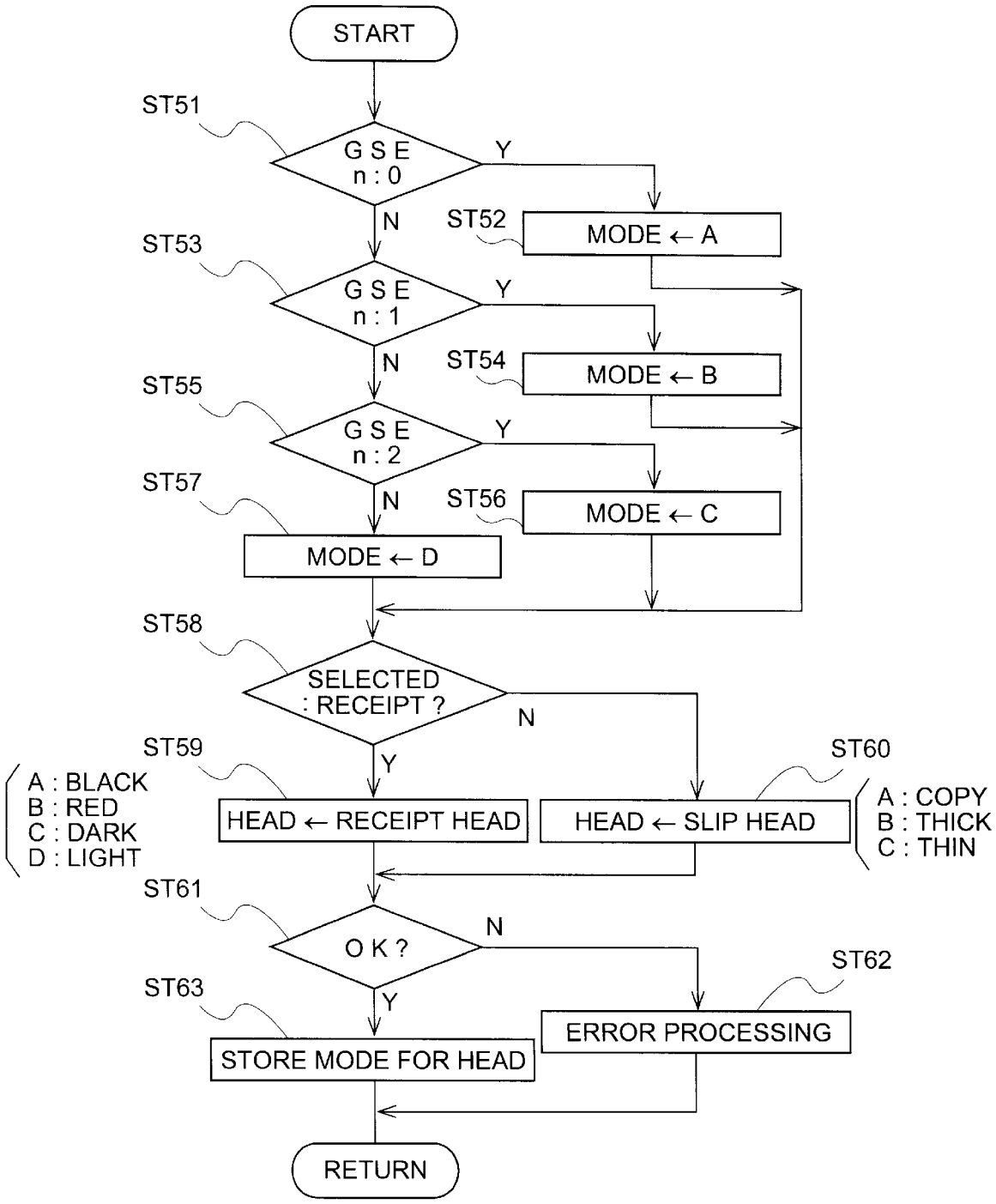
FIG. 10 is a flowchart of steps implemented to select a driving mode operation of FIG. 4 according to the second embodiment of the invention.
Figure 11:
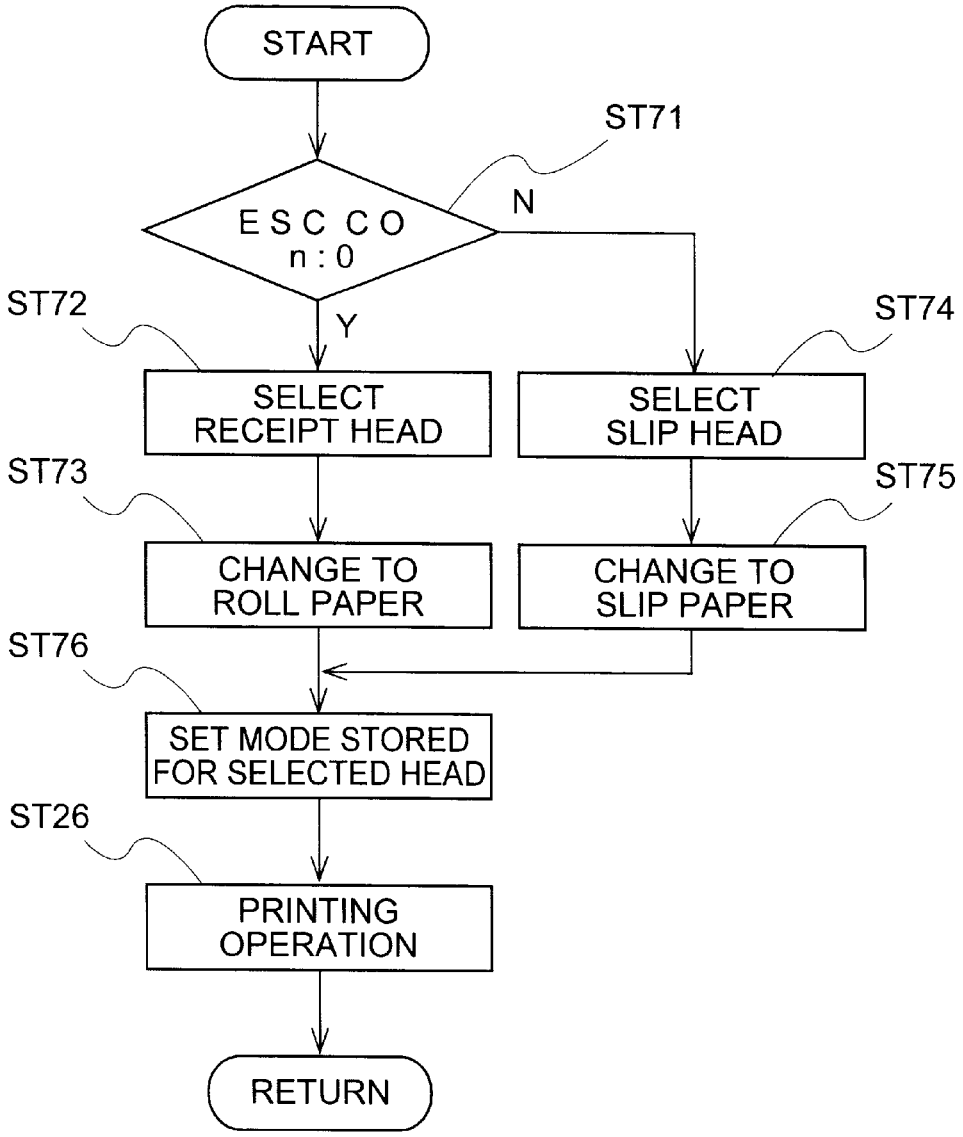
FIG. 11 is a flowchart of steps implemented to select the recording paper operation of FIG. 4 according to the second embodiment of the invention.

The sequence of steps used for selecting a driving mode (in step ST3 in the flowchart in FIG. 4) and type of recording paper (in step ST5 in the flowchart in FIG. 4) in a printer operating according to a second embodiment of the invention is explained in reference to FIGS. 10 and 11 respectively. The first series of steps in this sequence interprets the mode selection control command, starting in step ST51 (FIG. 10). Turning to FIG. 10, if the value of the parameter "n" following the control code "GS E" is 0, then the printing mode is subsequently set to mode A, in step ST52. However, if parameter "n" is not 0 but is determined, in step ST53, to be 1, then the printing mode is subsequently set to mode B, in step ST54. Likewise, if parameter "n" is neither 0 nor 1 but is determined, in step ST55, to be 2, then the printing mode is subsequently set to mode C, in step ST56. Furthermore, if parameter "n" is not 0, 1, or 2, then the printing mode is subsequently set to remaining mode D, in step ST57.

When interpreting the printing mode selected based on the mode selection control command is thus completed, the currently selected printing section is determined, in step ST58. As described above, printer 100 in this embodiment comprises print head 10*b* for receipt printing to thermal roll paper, and a print head 10*a* for slip printing to cut forms. These two print heads 10*b* and 10*a* correspond 1-to-1 to different types of recording paper, specifically thermal paper rolls and cut forms. It is therefore simple for print head drive controller 42 to select which print head 10*a* or 10*b* to select for printing based on the results of paper selection command interpretation by control command interpreter 45. It is also possible to supply the print data to the print head 10*a* or 10*b* specified for printing in place of the type of recording paper information. Because of this, printer 100 in this embodiment stores the printing mode parameters corresponding to print head 10*a* or 10*b* rather than corresponding to the type of recording paper. It will be obvious that printing mode parameters corresponding to the type of recording paper can also be stored.

Once it is determined, in step ST58, whether print head 10*a* or print head 10*b* is to be used for printing, the driving mode determined above is set in the selected print head. Note that this determination is made by, for example, interrogating a bit flag stored in mode/paper memory 53 as described above, and also used in the paper selection section such as the driving time determination unit 43, print head drive controller 42, and/or control command interpreter 45. In any case, if the selected print head is the receipt print head 10*b*, then a receipt print head is set as a print head for which the determined driving mode is to be set in step ST59. On the other hand, if the slip print head 10*a* is selected, then a slip print head is set in step ST60.

Whether the printing section and driving mode match is then determined, in step ST61. For example, if slip print head 10*a* is selected then printing mode (driving mode) D cannot be used. If a mismatch is determined, then an appropriate error processing sequence is run in step ST62. This error processing sequence can, for example, declare the mode selections invalid, or force selection of an appropriate mode.

If the selected printing mode and selected printing section are determined in step ST61 to be compatible, the printing mode selected for the printing section is stored to mode/paper memory section 53 in step ST63. Thereafter, whenever one of the printing sections is selected, the printing mode stored for that printing section in mode/paper memory section 53 is used for printing by that printing section.

The sequence of steps for selecting the recording paper in a printer 100 according to a second embodiment of the invention is explained next below with reference to the flowchart of FIG. 11. The first step in this sequence is to interpret the recording paper selection command "ESC c0 n" in step ST71. Because a parameter "n" value of 0 in printer 1 according to the present invention designates thermal roll paper, the receipt print head 10*b* corresponding to the recording paper selection is selected, in step ST72, if n=0. Then, in step ST73, processing is performed that switches any recording paper transport path or driving mechanism in the printer to a state or mode required for roll paper, a process that is substantially identical to step ST22 in shown in FIG. 6 for the first embodiment hereinabove.

However, if parameter n=1, cut form print head 10*a* is selected in step ST74. Processing is therefore performed, in step ST75, that switches any recording paper transport path or driving mechanism in the printer to a state or mode required for cut forms.

Once the printing section is set for the selected recording paper, the corresponding printing mode stored to mode/paper memory section 53 is set, in step ST76. The printing operation is then performed in step ST26 as described hereinabove with reference to the first described embodiment.

As a result of the operation described above, a printing mode corresponding to the selected printing section is automatically selected once the printing section to be used for printing is selected, and printing appropriate to the selected recording paper is performed. This results in a printer with improved general utility enabling, for example, a user that normally uses thin cut-forms to select the printing mode for thin paper, mode C in this example, by simply selecting this printing mode once at the first time cut forms are printed. Because this selection is automatically stored for slip print head 10*a* and used thereafter when printing cut forms, i.e., when printing with slip print head 10*a*. Whenever slip print head 10*a* is subsequently selected so that cut forms can be printed, mode C for thin forms is automatically selected to drive slip print head 10*a*.

Thus once the printing mode is appropriately set the first time roll paper or cut forms are printed in a printer 1 according to the present embodiment of the invention, the most appropriate printing mode is automatically selected and printing is accomplished using the most appropriate print head driving parameters whenever roll paper or cut forms are subsequently printed. The paper switching process of the printer according to the present invention is therefore extremely simple and can be quickly accomplished.

As described above, once a printing mode (driving mode) has been defined as appropriate for a particular type of recording paper using a printer or control method according to the present invention, the printing mode corresponding most appropriately to the precise specifications of a particular recording paper or printing medium, including the type and thickness of the recording medium, is automatically selected. Printing results are, therefore, also optimum whenever that type of recording paper is subsequently selected. It is also not difficult to set the printing mode because the printing mode is automatically selected according to the type of recording paper selected, and setting the printing mode can therefore be easily accomplished by any user.

It is therefore possible by means of the present invention to provide an easy to use, multiple function printer which can accommodate plural types of recording paper, can easily set a printing mode appropriate to a selected type of recording paper, and can thereafter automatically print with the best results by simply selecting the type of recording paper or the printing section corresponding thereto.

It should be noted that while the preceding embodiments have been described with reference to only two types of recording paper, the invention need not be so limited and it will become obvious to those ordinarily skilled in the art that the printer and control method of the invention can be easily adapted to accommodate three or more types of recording paper as well as other particular recording medium specifications.

While the invention has been described in conjunction with several specific embodiments, it is evident to those skilled in the art that many further alternatives, modifications and variations will be apparent in light of the foregoing description. Thus, the invention described herein is intended to embrace all such alternative, modifications, applications and variations as may fall within the spirit and scope of the appended claims.

What is claimed is:

1. A printer for selectively printing on a plurality of types of recording media, said printer comprising:

a control command interpreter that interprets commands sent from a host computer included in a media selection command;

a memory that stores printing modes for said plurality of types of recording media wherein the stored printing modes have a particular correspondence to said plurality of types of recording media;

a media selector that selects at least one type of recording media to be printed on according to the media selection command;

wherein said printer selects the printing mode stored in said memory corresponding to the type of recording media selected by said media selector to be printed on; and wherein said printer prints to the selected type of recording media using the selected printing mode.

2. The printer according to claim 1, further comprising:

a first printing section that prints to a first type of recording media;

a second printing section that prints to a second type of recording media that is different from said first type of recording media;

wherein said media selector selects one of the printing sections according to the type of recording media to be printed on;

wherein said memory stores printing modes for said first and second printing sections corresponding to the types of recording media to be printed on by those printing sections; and wherein said selected printing section prints to the corresponding type of recording media using the printing mode stored in said memory corresponding to said selected printing section.

3. The printer according to claim 1, further comprising:

a printing section that prints to a first type of recording media and to a second type of recording media that is different from said first type of recording media;

wherein said printer prints using a printing mode stored in said memory for said first type of recording media when said first type of recording media is selected by said media selector, and wherein said printer prints using a printing mode stored in said memory for said second type of recording media when said second type of recording media is selected by the media selector.

4. The printer according to claim 1 wherein said printer prints to the type of recording media selected by said media selector using the printing mode stored in said memory that is most appropriate to the type of recording media selected to be printed on.

5. A printer for selectively printing on a plurality of types of recording media, said printer comprising:

control command interpreter that interprets commands sent from a host computer included in a print mode selection command and a media selection command;

a memory that stores printing modes for said plurality of types of recording media wherein the stored printing modes have a particular correspondence to said plurality of types of recording media;

a media selector that selects at least one type of recording media to be printed on according to the media selection command;

a printing mode selector that selects at least one type of printing mode to be used for printing according to the print mode selection command;

wherein each of the printing modes selected by said printing mode selector is stored in said memory in correspondence with a respective type of recording media selected by said media selector, and wherein said printer prints to the type of recording media selected by said media selector using the printing mode selected by said printing mode selector.

6. The printer according to claim 5, further comprising:

a first printing section that prints to a first type of recording media;

a second printing section that prints to a second type of recording media that is different from said first type of recording media;

wherein said media selector selects one of the printing sections according to the type of recording media to be printed on; and wherein said selected printing section prints to the corresponding type of recording media using the printing mode selected by said printing mode selector.

7. The printer according to claim 5, further comprising:

a printing section that prints to a first type of recording media and to a second type of recording media that is different from said first type of recording media;

wherein said printer prints using a printing mode stored in said memory for said first type of recording media when said first type of recording media is selected by said media selector, and wherein said printer prints using a printing mode stored in said memory for said second type of recording media when said second type of recording media is selected by the media selector.

8. A control method for a printer, having a memory, used to selectively print on a plurality of types of recording media, said control method comprising the steps of:

storing printing modes for said plurality of types of recording media wherein the stored printing modes have a particular correspondence to said plurality of types of recording media;

selecting at least one type of recording media to be printed on;

wherein said printer selects the printing mode stored in said memory corresponding to the type of recording media selected; and printing to the selected type of recording media using the selected printing mode.

9. The control method according to claim 8, further comprising:

selecting one of a plurality of printing sections for printing to a particular type of recording media wherein a first printing section has a first printing mode stored in said memory and a second printing section has a second printing mode stored in said memory; and wherein said recording media selection step enables printing by said selected printing section to the corresponding type of recording media using the printing mode stored in said memory for that type of recording media.

10. The control method according to claim 8 wherein said printer further comprises a printing section for printing to a first type of recording media and to a second type of recording media that is different from said first type of recording media and wherein said recording media selection step enables printing by said printing section in a printing mode stored in said memory for said first type of recording media when said first type of recording media is selected, and wherein said recording media selection step enables printing by said printing section in a printing mode stored in said memory for said second type of recording media when said second type of recording media is selected.

11. A control method for a printer, having a memory, used to selectively print on a plurality of types of recording media, said control method comprising the steps of:

selecting at least one type of recording media to be printed on;

selecting at least one printing mode to be used for printing;

storing each of the printing modes selected by said printing mode selection step in said memory in correspondence with a respective type of recording media selected by said media selection step; and printing to the type of recording media selected by said media selection step using the printing mode selected by said printing mode selection step.

12. The control method according to claim 11, further comprising:

selecting one of a plurality of printing sections for printing to a particular type of recording media wherein a first printing section has a first printing mode stored in said memory and a second printing section has a second printing mode stored in said memory; and storing in said memory the printing modes for said first and second printing sections corresponding to the types of recording media to be printed on by those printing sections.

13. The control method according to claim 11, wherein said printer further comprises a printing section for printing to a first type of recording media and to a second type of recording media that is different from said first type of recording media, said control method further comprising:

printing using a printing mode stored in said memory for said first type of recording media when said second type of recording media is selected and printing using a printing mode stored in said memory for said second type of recording media when said first type of recording media is selected.

* * * * *

UNITED STATES PATENT AND TRADEMARK OFFICE

CERTIFICATE OF CORRECTION

PATENT NO. : 6,141,028
DATED : October 31, 2000
INVENTOR(S) : Kazuhisa Aruga

It is certified that error appears in the above-identified patent and that said Letters Patent is hereby corrected as shown below:

Column 14, claim 5,
Line 61, before "control" insert -- a --.

Signed and Sealed this

Nineteenth Day of February, 2002

*Attest:*

*Attesting Officer*

JAMES E. ROGAN
*Director of the United States Patent and Trademark Office*